US008860538B2

(12) United States Patent
Andersson et al.

(10) Patent No.: US 8,860,538 B2
(45) Date of Patent: Oct. 14, 2014

(54) INDUCTOR CORE

(75) Inventors: Ola Andersson, Höganäs (SE); Lars-Olov Pennander, Helsingborg (SE)

(73) Assignee: Hoganas AB (Publ), Hoganas (SE)

( * ) Notice: Subject to any disclaimer, the term of this patent is extended or adjusted under 35 U.S.C. 154(b) by 0 days.

(21) Appl. No.: 13/977,874

(22) PCT Filed: Dec. 22, 2011

(86) PCT No.: PCT/EP2011/073829
§ 371 (c)(1), (2), (4) Date: Jul. 18, 2013

(87) PCT Pub. No.: WO2012/093040
PCT Pub. Date: Jul. 12, 2012

(65) Prior Publication Data

US 2013/0328651 A1 Dec. 12, 2013

Related U.S. Application Data

(60) Provisional application No. 61/429,870, filed on Jan. 5, 2011.

(30) Foreign Application Priority Data

Jan. 3, 2011 (EP) ..... 11150015

(51) Int. Cl.

| | |
|---|---|
| ***H01F 3/00*** | (2006.01) |
| ***H01F 3/10*** | (2006.01) |
| ***H01F 17/04*** | (2006.01) |
| *H01F 3/14* | (2006.01) |

(52) U.S. Cl.
CPC .. *H01F 3/00* (2013.01); *H01F 3/10* (2013.01); *H01F 17/045* (2013.01); *H01F 3/14* (2013.01)
USPC ..... 335/297; 336/83

(58) Field of Classification Search
USPC ..... 335/296, 297; 336/83; 361/65, 83, 90, 361/92, 96, 98, 221
See application file for complete search history.

(56) References Cited

U.S. PATENT DOCUMENTS

| | | | | |
|---|---|---|---|---|
| 8,458,890 | B2 * | 6/2013 | Sakamoto | 29/602.1 |
| 2005/0104702 | A1 | 5/2005 | Sano | |
| 2006/0186978 | A1 | 8/2006 | Kawarai | |
| 2010/0308950 | A1 | 12/2010 | Hsieh et al. | |

OTHER PUBLICATIONS

International Search Report (PCT/ISA/210) issued on Apr. 12, 2012, by the European Patent Office as the International Searching Authority for International Application No. PCT/EP2011/073829.
Written Opinion (PCT/ISA/237) issued on Apr. 12, 2012, by the European Patent Office as the International Searching Authority for International Application No. PCT/EP2011/073829.

* cited by examiner

*Primary Examiner* — Bernard Rojas
(74) *Attorney, Agent, or Firm* — Buchanan Ingersoll & Rooney P.C.

(57) ABSTRACT

According to one aspect, there is provided an inductor core including: an axially extending core member, an axially extending external member at least partly surrounding the core member, thereby forming a space around the core member for accommodating a winding between the core member and the external member, a plate member presenting a radial extension and being provided with a through-hole, wherein the core member is arranged to extend into the through-hole, wherein the plate member is a separate member from the core member and the external member and is adapted to be assembled with the core member and the external member, wherein a magnetic flux path is formed which extends through the core member, the plate member and the external member.

14 Claims, 7 Drawing Sheets

INDUCTOR CORE

TECHNICAL FIELD

The present inventive concept relates to inductor cores.

BACKGROUND

Inductors are used in a wide array of applications such as signal processing, noise filtering, power generation, electrical transmission systems etc. In order to provide more compact and more efficient inductors, the electrically conducting winding of the inductor may be arranged around an elongated magnetically conducting core, i.e. an inductor core. An inductor core is preferably made of a material presenting a higher permeability than air wherein the inductor core may enable an inductor of increased inductance.

Inductor cores are available in a large variety of designs and materials, each having their specific advantages and disadvantages. However, in view of the ever increasing demand for inductors in different applications there is still a need for inductor cores having a flexible and efficient design and which are usable in a wide range of applications.

SUMMARY

In view of the above, an objective of the present inventive concept is to meet this need. In the following, inductor cores in accordance with a first and a second aspect of the inventive concept will be described. These inventive inductor cores provide an improvement in that they make a plurality of more specific inductor core designs possible, each design having its inherent advantages but all presenting common performance and manufacturing related advantages.

According to the first aspect there is provided an inductor core comprising: an axially extending core member, an axially extending external member at least partly surrounding the core member, thereby forming a space around the core member for accommodating a winding between the core member and the external member, a plate member presenting a radial extension and being provided with a through-hole, wherein the core member is arranged to extend into the through-hole, wherein the plate member is a separate member from the core member and the external member and is adapted to be assembled with the core member and the external member, wherein a magnetic flux path is formed which extends through the core member, the plate member and the external member.

By the configuration of the members a magnetic flux path of low reluctance may be obtained. The external member at least partly surrounding the core member may thus provide the double effect of confining a magnetic flux, generated by a current flowing in the winding, to the inductor core and thereby minimize or at least reduce interference with the surroundings while acting as a flux conductor.

To provide a low reluctance magnetic flux path, inductor cores are usually made of materials having a high magnetic permeability. However, such materials may easily become saturated, especially at higher magnetomotive force (MMF). Upon saturation, the inductance of the inductor may decrease wherein the range of currents for which the inductor core is usable is reduced. A known measure to improve the usable range is to arrange a magnetic flux barrier e.g. in the form of an air gap in the part of the core about which the winding is arranged. For an elongated prior art core, the air gap thus extends in the axial direction of the core. A properly arranged air gap results in a reduced maximum inductance. It also reduces the inductance sensitivity to current variations. The properties of the inductor may be tailored by using air gaps of different lengths.

A magnetic field will tend to spread in directions perpendicular to the direction of the flux path when the magnetic flux is forced across the air gap. This spreading of flux is generally referred to as the "fringing flux". A small, or short, air gap will fringe the field less than a large, or long, air gap. The air-gap fringing will decrease the flux reluctance and thereby increase the inductance of the inductor. However, there will also be eddy-currents generated in the surrounding winding wires if this magnetic fringing flux is changing in time and the field overlaps the wire geometry. Eddy-currents in the wire will increase winding losses. The prior art arrangement of the air gap may hence entail efficiency losses due to fringing flux at the air gap interacting with the winding. To reduce these losses, the arrangement of the winding in the region of the air gap needs to be carefully considered. Additionally, it may be necessary to use a well designed wire geometry e.g. a flat foil winding or a Litz-wire using multiple strands of very thin wires in order to reduce these losses.

The inventive inductor core design of the first aspect enables a departure from the above-mentioned prior art approach. More specifically it enables a magnetic flux barrier to be arranged in a radially extending portion of the magnetic flux path. Such a "radial magnetic flux barrier" makes it possible to separate fringing flux, arising at the magnetic flux barrier, from the windings and thereby mitigate related efficiency losses.

"A magnetic flux barrier" may be construed as a barrier arranged in the inductor core and presenting a radial length extension and reluctance such that the barrier will be a determining factor for the total reluctance of the magnetic flux path. The flux barrier may hence also be referred to as a barrier of magnetic reluctance.

According to one embodiment, the magnetic flux barrier includes a material of reduced magnetic permeability which is integrated with the plate member and distributed over a radial portion of thereof. The length of the radial portion may correspond to the full radial extension of the plate member or only a part thereof.

According to one embodiment, the magnetic flux barrier is arranged between the core member and the plate member, the magnetic flux barrier thereby separating the core member and the plate member. By providing a through-hole in the core member wherein the core member extends into the through-hole the "radial magnetic flux barrier" may be easily formed by a space or gap extending between the core and the plate member. Such a magnetic flux barrier may be referred to as "a radially inner magnetic flux barrier". Providing the magnetic flux barrier at the position where the magnetic flux path transitions from an axial to a radial direction makes it possible to achieve a very small presence of fringing flux outside the inductor core since the major part of the fringing flux between the core member and the plate member may appear on the inside of the inductor core.

According to one embodiment, the external member at least partly surrounds the plate member. This enables a stable construction since the magnetic flux path at the interfaces between both the core member and the plate member as well as the plate member and the external member is radially directed. Flux induced axial stress on the inductor core may thereby be kept low.

By arranging the external member to at least partly surround the plate member it becomes possible to arrange the magnetic flux barrier between the plate member and the external member, the magnetic flux barrier thereby separating the external member and the plate member from each other. Such a magnetic flux barrier may be referred to as "a radially outer magnetic flux barrier". The radially outer magnetic flux barrier and the radially inner magnetic flux barrier provide the same or corresponding advantages. The radially outer magnetic flux barrier however provides an additional advantage in that it enables a further separation of fringing flux, arising at the radially outer magnetic flux barrier, from the windings whereby related efficiency losses may be mitigated.

According to one embodiment, the inductor core comprises both a radially inner magnetic flux barrier and a radially outer magnetic flux barrier. Thus, a first magnetic flux barrier is arranged between the core member and the plate member and a second magnetic flux barrier is arranged between the plate member and the external member. Such a double barrier arrangement may provide increased design flexibility in some cases. Moreover, a double barrier arrangement enables a reduced fringing flux outside the inductor core compared to a single barrier arrangement since each barrier may be provided with a smaller radial thickness while maintaining the same combined contribution to the total reluctance of the magnetic flux path as the single barrier arrangement. A smaller radial thickness enables a smaller separation between the respective members which in turn leads to less fringing flux.

As may be understood from the above, the inductor core of the first aspect presents a modular design wherein the plate member, may be formed separately from the core member and the external member. The production for the plate member may thus be optimized in isolation from the production of the other members. The members may thereafter be assembled together in a convenient manner.

According to one embodiment, the members are made of a soft magnetic powder material. The soft magnetic powder material may be a soft magnetic composite (SMC). The soft magnetic composite may comprise magnetic powder particles (e.g. iron particles) provided with an electrically insulating coating. The through-hole in the plate member makes it possible to manufacture larger inductor cores using the same amount of pressing force, or conversely to manufacture prior art-sized inductor cores using less pressing force.

The inductor core design in accordance with the first aspect also offers tolerance related advantages during manufacturing. The core member, the plate member and/or the external member may be manufactured by uniaxial compaction of the soft magnetic powder material. The core member, the plate member and/or the external member may be manufactured by molding the soft magnetic powder material. The molding may include compacting the powder material by pressing in a direction corresponding to the axial direction of each respective member. In the radial direction, the dimension of the member is limited by the cavity walls of the mould. A member may thus be manufactured using uniaxial compaction with a much tighter tolerance in the radial direction than in the axial direction. Consequently the manufactured members may present dimensions in the radial direction with high accuracy. This is advantageous since it enables an accurate fit to be achieved between the, in relation to each other, radially distributed members. Furthermore, the length of the radial extension of a magnetic flux barrier (e.g. determined by the radius of the through-hole and the radial extension of the core member, or by the radial extension of the plate member and the radial dimension of the external member) may be accurately determined which in turn enables good precision for the inductance in the final inductor product. This degree of precision would be very difficult to achieve when manufacturing a compacted inductor core with an axially extending air gap.

According to one embodiment, the core member, the external member and the plate member are separate members which are adapted to be assembled and together form the magnetic flux path extending through the core member, the plate member and the external member. Thereby each member may be separately manufactured in a convenient manner. The member may be made of a soft magnetic powder material wherein members of the inductor core may be efficiently produced using single-level tooling.

The modular design of the inductor core further enables a hybrid design of the inductor core wherein each member may be formed in the most appropriate material.

According to one embodiment a flux conducting cross-sectional area of the external member exceeds a flux conducting cross-sectional area of the core member. This may be advantageous in some applications. It may be especially advantageous for some hybrid designs. For example, the core member may be made of a soft magnetic composite material and the external member may be made of ferrite, such as a soft ferrite.

A ferrite material may present a higher permeability and lower eddy current losses than a soft magnetic composite but also a lower level of saturation. The lower saturation level may however be compensated for by making the flux conducting cross-sectional area of the external member larger than the flux conducting cross-sectional area of the core member. The saturation level of the external member may thus be increased wherein the overall losses of the inductor core may be reduced.

According to one embodiment, the core member is made of soft magnetic powder and the plate member is made of a plurality of laminated conducting sheets extending in the radial direction. Since the core member extends into the through-hole of the plate member, the flux may be efficiently transferred between the axially extending core member and the radially extending conducting sheets of the plate member. If this is combined with arranging the external member to at least partly surround the plate member, the flux may be efficiently transferred also between the conducting sheets of the plate member and the external member.

According to one embodiment, the plate member presents an axial dimension which decreases in an outward radial direction. Since the circumference of the plate member increases along the outward radial direction, the axial dimension of the plate member may be gradually reduced while maintaining the same flux conducting cross-sectional area as at the interface between the plate member and the core member. The amount of material required for the plate member may thus be reduced without adversely affecting the efficiency.

According to one embodiment the through-hole of the plate member presents a decreasing radial dimension along a direction towards an outer axial side of the plate member. The outer axial side is the side of the plate member which faces in a direction away from the winding space between the core member and the external member.

According to one embodiment the core member extends completely through the through-hole. This enables a large interface between the core member and the plate member.

According to one embodiment the core member extends through and beyond the through-hole. This enables the core member to be provided with cooling means wherein heat generated by the magnetic flux and the winding currents may be efficiently dissipated from the inductor core.

According to one embodiment the plate member is a first plate member and the inductor core further comprises an additional, or second, plate member. The first plate member and the second plate member may be provided at opposite ends of the external member. The first plate member and the second plate member may be provided at opposite ends of the core member. The core member, the external member, the first plate member and the second plate member may form separate members and may be adapted to be assembled.

Alternatively, the second plate member may be formed in one piece with the core member and the external member and be arranged to extend in a radial direction between the core member and the external member. This enables a very stable construction.

When assembled the members may together form a magnetic flux path extending through the core member, the first plate member, the external member and the second plate member. Moreover, the members enable a closed inductor core design efficiently shielding the magnetic flux generated by the winding currents from the surrounding.

According to the second aspect, there is provided an inductor core comprising: a core member comprising an axially extending core part and a radially extending plate member formed in one piece with said core part, an axially extending external member at least partly surrounding the core part, thereby forming a space around the core part for accommodating a winding between the core part and the external member, the external member further at least partly surrounding the plate member, wherein the core member and the external member are separate members which are adapted to be assembled and together form a magnetic flux path extending through the core part, the plate member and the external member.

By the configuration of the members a magnetic flux path of relatively low reluctance may be obtained. The external member at least partly surrounding the core member may confine a magnetic flux generated by a current flowing in the winding to the inductor core and thereby minimize or at least reduce interference with the surroundings while acting as a flux conductor.

The external member at least partly surrounds the plate member. This enables a stable construction since the magnetic flux path at the interface between the plate member and the external member is radially directed. Flux induced axial stress on the inductor core may thereby be kept low. This in combination with the core part and the plate member being integrated further adds to the stability.

To provide a low reluctance magnetic flux path, inductor cores are usually made of materials having a high magnetic permeability. However, such materials may easily become saturated, especially at high magnetomotive force (MMF). Upon saturation, the inductance of the inductor may decrease wherein the range of currents for which the inductor core is usable is reduced. A known measure to improve the usable range is to arrange an air gap in the part of the core about which the winding is arranged. For an elongated prior art core, the air gap thus extends in the axial direction of the core. A properly arranged air gap results in a reduced maximum inductance. However it also reduces the inductance sensitivity to current variations. The properties of the inductor may be tailored by using air gaps of different lengths.

A magnetic field will tend to spread in directions perpendicular to the direction of the flux path when the magnetic flux is forced across the air gap. This spreading of flux is generally referred to as the "fringing flux". A small, or short, air gap will fringe the field less than a large, or long, air gap. The air-gap fringing will decrease the flux reluctance and thereby increase the inductance of the inductor. However, there will also be eddy-currents generated in the surrounding winding wires if this magnetic fringing flux is changing in time and the field overlaps the wire geometry. Eddy-currents in the wire will increase winding losses. The prior art arrangement of the air gap may hence entail efficiency losses due to fringing flux at the air gap interacting with the winding. To reduce these losses, the arrangement of the winding in the region of the air gap needs to be carefully considered. Additionally, it may be necessary to use a well designed wire geometry e.g. a flat foil winding or a Litz-wire using multiple strands of very thin wires in order to reduce these losses.

The inventive inductor core design of the second aspect enables a departure from the above-mentioned prior art approach. More specifically it enables a magnetic flux barrier to be arranged in a radially extending portion of the magnetic flux path. Such a "radial magnetic flux barrier" makes it possible to separate fringing flux, arising at the magnetic flux barrier, from the windings and thereby mitigate related efficiency losses.

According to one embodiment, the magnetic flux barrier includes a material of reduced magnetic permeability which is integrated with the plate member and distributed over a radial portion of thereof. The length of the radial portion may correspond to the full radial extension of the plate member or only a part thereof.

According to the second aspect the external member at least partly surrounds the plate member. This enables the magnetic flux barrier to be arranged between the plate member and the external member, the magnetic flux barrier thereby separating the plate member and the external member from each other. Providing the magnetic flux barrier at the position where the magnetic flux path transitions from an axial to a radial direction makes it possible to achieve a very small fringing flux outside the inductor core since the major part of the fringing flux between the core member and the external member may appear on the inside of the inductor core.

The inductor core of the second aspect presents a modular design wherein the core member and the external member may be formed separately from each other. The production method for each member may thus be optimized in isolation from the production methods of the other member. The members may thereafter be assembled together in a convenient manner.

According to one embodiment, the members are made of a soft magnetic powder material. The soft magnetic powder material may be a soft magnetic composite (SMC). The soft magnetic composite may comprise magnetic powder particles (e.g. iron particles) provided with an electrically insulating coating.

The second aspect also offers advantages related to tolerances during manufacturing. The core member, the plate member and/or the external member may be manufactured by uniaxial compaction of the soft magnetic powder material. The core member and/or the external member may be manufactured by molding the soft magnetic powder material. The molding may include compacting the powder material by pressing in a direction corresponding to the axial direction of the respective member. In the radial direction, the dimension of the member is limited by the mould. A member may thus be manufactured using uniaxial compaction with a much tighter tolerance in the radial direction than in the axial direction. The thus manufactured member may thus present very tight tolerances in the radial direction. This is advantageous since it enables a good fit to be achieved between the core member and the external member. Furthermore, the length of the radial extension of the magnetic flux barrier (e.g. determined by the radial dimension of the plate member and the external member) may be accurately determined which in turn enables good precision for the inductance in the final inductor product. This degree of precision would be very difficult to achieve for an inductor core with an axially extending air gap.

The modular design of the inductor core further enables a hybrid design of the inductor core wherein each member may be formed in the most appropriate material.

According to one embodiment a flux conducting cross-sectional area of the external member taken along the flux path exceeds a flux conducting cross-sectional area of the core part. This may be advantageous for some applications. For example, it may be advantageous for some hybrid designs. As a more specific example, the core member may be made of soft magnetic composite material and the external member may be made of ferrite.

Ferrite may present a higher permeability and lower eddy current losses than a soft magnetic composite but also a lower level of saturation. The lower saturation level may however be compensated for by making the flux conducting cross-sectional area of the external member larger than the flux conducting cross-sectional area of the core part of the core member. The saturation level of the external member may thus be increased wherein the overall losses of the inductor core may be reduced.

According to one embodiment, the plate member of the core member presents an axial dimension which decreases in an outward radial direction. Since the circumference of the plate member increases along the outward radial direction, the axial dimension of the plate member may be gradually reduced while maintaining the same flux conducting cross-sectional area as at the transition between the core part and the plate member. The amount of material required for the inductor core may thus be reduced without adversely affecting the efficiency.

According to one embodiment the inductor core further comprises a second plate member. The inductor core thus comprises a first plate member and a second plate member. The first plate member and the second plate member may be provided at opposite ends of the external member. The first plate member and the second plate member may be provided at opposite ends of the core part. The second plate member may be formed as a radially extending protrusion on the core part. When assembled the members may together form a magnetic flux path extending through the core part, the first plate member, the external member and the second plate member. Moreover, the members enable a closed inductor core design efficiently shielding the magnetic flux generated by the winding currents from the surrounding.

According to one embodiment the second plate member may be provided with a through-hole wherein the core part of the core member extends into the through-hole. The external member may at least partly surround the second plate member. In addition to the magnetic flux barrier at the first plate member, a second radially extending magnetic flux barrier may be arranged at the second plate member. The second magnetic flux barrier may be arranged between the core member and the plate member, the second magnetic flux barrier thereby separating the core member and the plate member. The second magnetic flux barrier may be arranged between the second plate member and the external member thereby separating the second plate member and the external member.

BRIEF DESCRIPTION OF THE DRAWINGS

The above, as well as additional objects, features and advantages of the present inventive concept, will be better understood through the following illustrative and non-limiting detailed description of preferred embodiments of the present inventive concept, with reference to the appended drawings, where like reference numerals will be used for like elements unless stated otherwise, wherein.

DETAILED DESCRIPTION OF PREFERRED EMBODIMENTS

Figure 1:
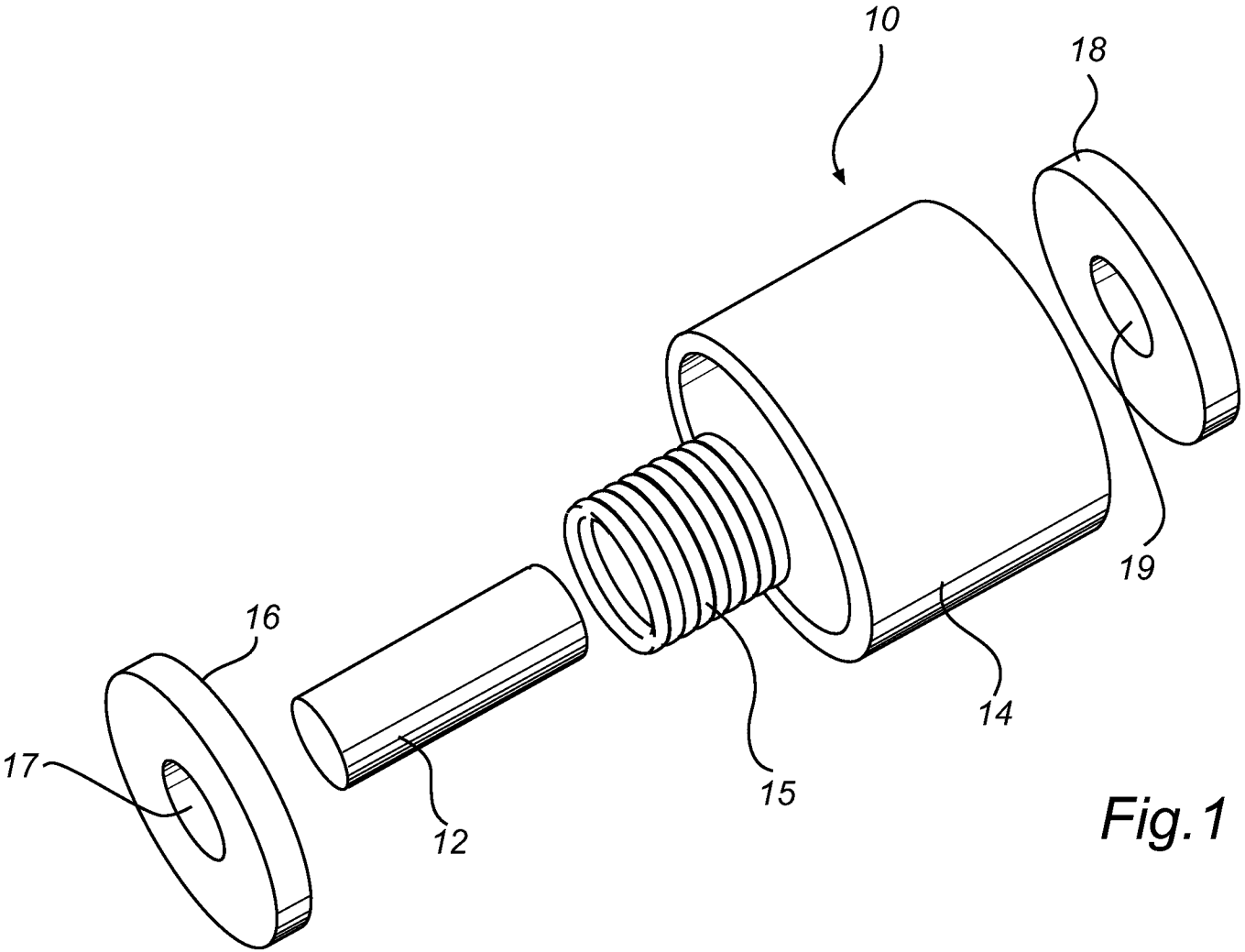
FIG. 1 is schematic exploded view of an embodiment of an inductor core.

FIG. 1 is a schematic exploded view of an embodiment of an inductor core 10 comprising a plurality of separate members adapted to be assembled. The inductor core 10 comprises an axially extending core member 12 and an axially extending external member 14. The core member 12 presents a circular cross section. The external member 14 presents a ring-shaped cross section. Once the inductor core 10 is assembled, the external member 14 surrounds the core member 12 in a circumferential direction, thereby forming a radially and axially extending space between the core member 12 and the external member 14, which space is for accommodating a winding 15 (schematically indicated).

The inductor core 10 further comprises a first ring- or disc-shaped plate member 16 and a second ring- or disc-shaped plate member 18. Each of the first and the second plate members 16, 18 are provided with a through-hole 17, 19. Each of the through-holes extend axially through their respective plate members 16, 18. The through-holes 17, 19 are arranged to receive a respective end portion of the core member 12. Once the inductor core 10 is assembled, the core member 12 extends into the through-holes 17, 19, the first and the second plate members 16, 18 being arranged at opposite ends of the core member 12.

The first and second plate members 16, 18 present an extension in the radial direction. Thus, the first and the second plate members 16, 18 each present an extension in a plane which is perpendicular to the axial direction.

The inductor core 10 may further comprise a winding lead-through (not shown for clarity). The lead through may be arranged e.g. in the external member 14, in the plate member 16 or in the plate member 18.

Once the inductor core 10 is assembled, the external member 14 surrounds also the plate members 16, 18 in the circumferential direction. Hence, the interface between the external member 14 and each of the first and second plate members 16, 18 extends circumferentially and axially. Moreover, the interface between the core member 12 and each of the first and second plate members 16, 18 extends circumferentially and axially. The radius of the through-holes 17, 19 may be constant along the axial direction. Alternatively, one or both of the through-holes 17, 19 may be conically shaped. The radius of the through-holes 17 and/or 19 may thus decrease along the axial direction towards the end portions of the core member 12. The corresponding end portions of the core member 12 may present a corresponding shape.

Figure 2:
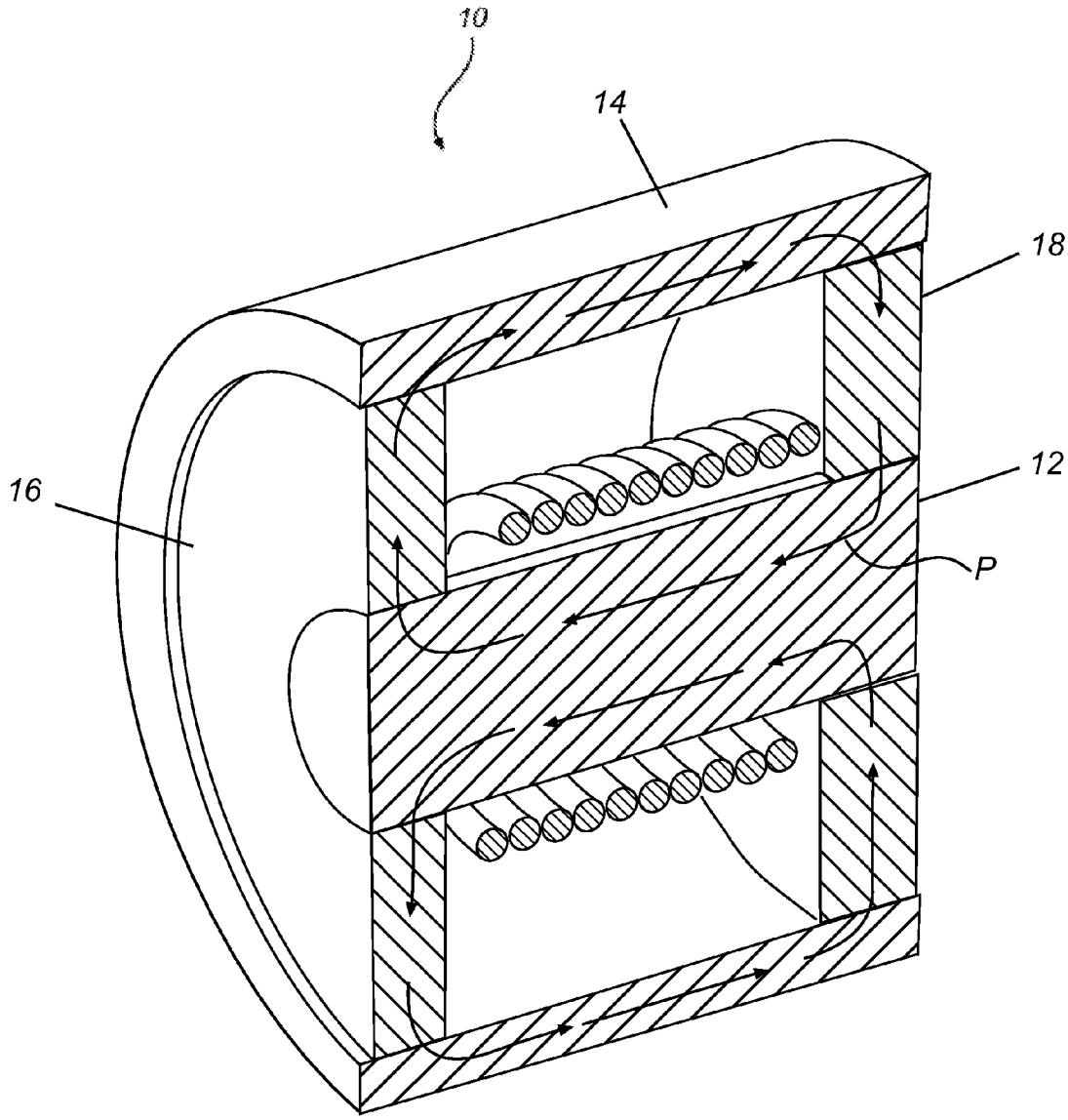
FIG. 2 is an illustration of an inductor core in assembled condition.

FIG. 2 is a schematic perspective and cut away view of the inductor core 10 in an assembled condition. The core member 12, the external member 14 and the plate members 16, 18 together form a magnetic flux path P. The flux path P forms a closed loop extending through the core member 12, the plate member 16, the external member 14, the plate member 18 and back into the core member 12. The axial direction coincides with, or corresponds to, the direction of the flux path P in the core member 12, i.e. inside the winding. A portion of the flux path extends radially through the plate members 16, 18. As will be described in more detail below this enables a radially extending magnetic flux barrier.

As illustrated in FIG. 2 the core member 12 extends fully through the axial extension of the through-holes 16, 18. However, according to an alternative arrangement the core member 12 may extend only partially through the through-holes 16, 18.

The modular configuration of the inductor core 10 makes it possible to form the inductor core 10 from a variety of different materials and material combinations.

According to a first design, the core member 12, the external member 14 and the plate members 16, 18 may be made of compacted magnetic powder material. The material may be soft magnetic powder. The material may be ferrite powder. The material may be soft magnetic composite material. The composite may comprise iron particles provided with an electrically insulating coating. Advantageously, the resistivity of the material may be such that eddy currents are substantially suppressed. As a more specific example, the material may be a soft magnetic composite from the product family Somaloy (e.g. Somaloy® 110i, Somaloy® 130i or Somaly® 700HR) from Höganäs AB, S-263 83 Höganäs, Sweden.

The soft magnetic powder may be filled into a die and compacted. The material may then be heat treated, e.g. by sintering (for powder materials such as ferrite powder) or at a relatively low temperature so as not to destroy an insulating layer between the powder particles (for soft magnetic composites). During the compaction process a pressure is applied in a direction corresponding to the axial direction of the respective member. In the radial direction, the dimension of the member is limited by the cavity walls of the mould. A member may thus be manufactured using uniaxial compaction with a tighter tolerance in the radial direction than in the axial direction.

As may be seen from FIG. 2, the length of the axially extending portion of the flux path P in the core member 12 and also in the external member 14 is determined by the positions of the plate members 16, 18 in relation to the core member and the external member 14. Thus, the axial separation between the first plate member 16 and the second plate member 18 determines the axial length of the flux path P. Any inaccuracies in the axial length of the core member 12 and/or the external member 14 due to the compaction method discussed above may thus be compensated for by a careful arrangement of the plate members 16, 18 in relation to the core member 12 and the external member 14. As will be understood by those skilled in the art, it is much more feasible to accurately arrange the plate members 16, 18 than to reduce the acceptable manufacturing tolerance interval of the core member 12 and the external member 14 in the axial direction.

Furthermore, as mentioned above the tolerance interval in the radial direction may be made relatively tight. Thus, also the length of the radially extending portions of the flux path P (i.e. through the plate members 16, 18) may be made accurate. Since the inductance of a final inductor will depend on the total length of the flux path P the design according to the inductor core 10 enables manufacturing of inductors presenting a precise inductance.

The tight tolerance in the radial direction presents further advantages in that it enables an accurate fit to be achieved between the, in relation to each other, radially distributed members 12, 14, 16, 18. For example a tight tolerance for the radial dimension of the through-holes 17, 19 and the core member 12 may be achieved. This in turn makes it possible to introduce a magnetic flux barrier having a well-defined radial extension in the inductor core 10 at the plate members 16, 18. Various magnetic flux barrier configurations will be described below.

According to a second design, the core member 12 and the external member 14 may be made of soft magnetic powder material of any of the types discussed in connection with the first design. The plate members 16, 18 may be made of a plurality of conducting and laminated sheets extending in the radial direction, e.g. laminated sheet steel, the sheets being arranged as to extend perpendicularly to the axial direction. The lamination may be achieved by arranging a layer of electrical resistance between two adjacent sheets. The tolerance related advantages discussed in connection with the first design are applicable also to this design.

According to a third design, the core member 12 may be made of a soft magnetic composite. The plate members 16, 18 may be made of soft magnetic powder material of any of the types discussed in connection with the first and the second design. The external member 14 may be made of ferrite. Advantageously, the ferrite may be a soft ferrite powder. During manufacturing, the external member 14 may be formed by compaction and sintering of the ferrite, the external member 14 thus forming a sintered ferrite compact. The external member 14 may present a flux conducting cross-sectional area which is larger than the flux conducting cross-sectional area of the core member 12. A ferrite material may present a higher permeability and lower eddy current losses than a soft magnetic composite but also a lower level of saturation. In this case, the lower saturation level is however compensated for by the increased flux conducting cross-sectional area of the external member 14. The saturation level of the external member 14 may thus be increased wherein the overall losses of the inductor core may be reduced. The tolerance related advantages discussed in connection with the first and the second design are applicable also to this design.

Further variations of these three designs are possible, e.g. a core member 12 of soft magnetic powder material, plate members 16, 18 of laminated sheets and an external member of ferrite.

Figure 3A:
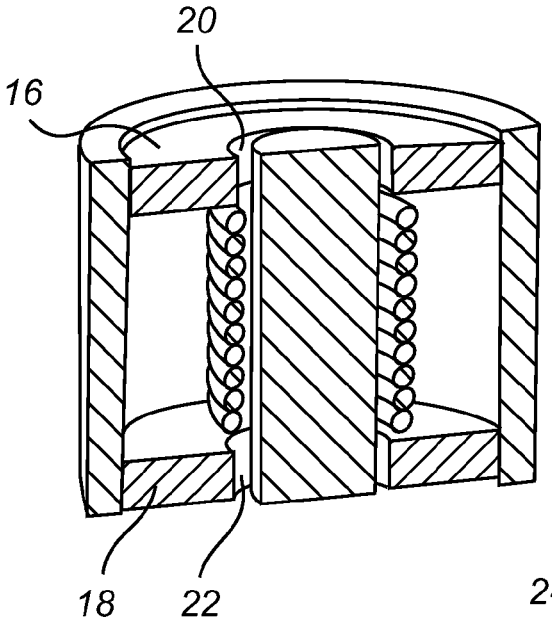
FIGS. 3*a-c* illustrate various inductor core designs.
Figure 3B:
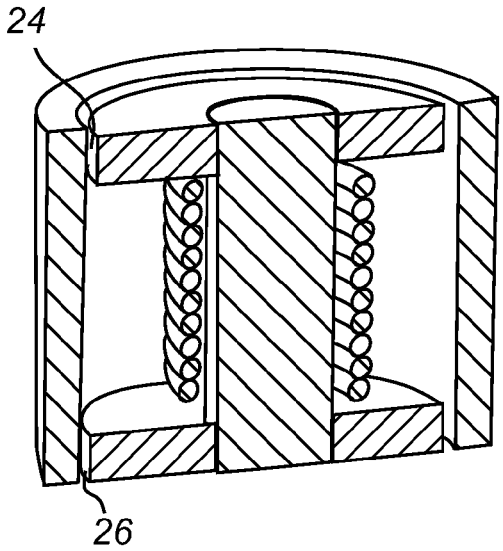
Figure 3C:
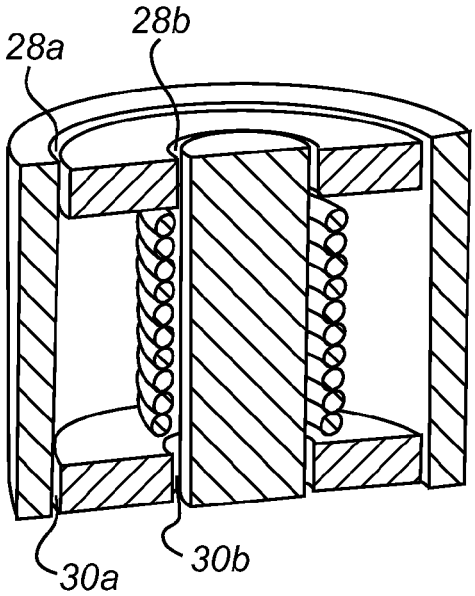

With reference to FIGS. 3*a-c*, the inductor core 10 may comprise a radial magnetic flux barrier.

With reference to FIG. 3*a*, the radial dimension of the through-hole 17 and 19 may be larger than the radial dimension of the portions of the core member 12 received by the through-holes 17, 19. A radially inner magnetic flux barrier 20 may thus be arranged in the gap between the core member 12 and the plate member 16. Correspondingly, a radially inner magnetic flux barrier 22 may be arranged in the gap between the core member 12 and the plate member 18. The barriers 20, 22 form ring-shaped gaps. The gaps extend axially and radially between the inner axially and circumferentially extending boundary surface of the through-hole 17, 19 of each respective plate member 16, 18 and the axially and circumferentially extending boundary surface of the core member 12.

By means of the above-discussed tight radial tolerance intervals obtainable for compacted components, the radial extension of the gaps, and thus the reluctance of each magnetic flux barrier, may be very precisely determined.

The gaps may be filled with air, wherein the magnetic flux barrier 20 and the magnetic flux barrier 22 each include an air gap. Alternatively, the gaps may be filled with a material presenting a significantly reduced magnetic permeability compared to the members forming the magnetic flux path. "Sufficiently reduced" may be construed such that the length of the radial extension of the material having significantly reduced magnetic permeability will be a determining factor for the total reluctance of the magnetic flux path. By way of example, the material may be a plastic material, a rubber material or a ceramic material. Hence, each magnetic flux barrier 20, 22 may be include a ring-shaped member made of a material presenting a sufficiently reduced magnetic permeability and being arranged between the core member 12 and the plate member 16 and the plate member 18, respectively. The core member 12 may thus extend through the ring-shaped members. The ring-shaped members may be attached to the core member and the plate member 16 and 18 respectively e.g. by gluing or the like.

Alternatively, a magnetic flux barrier need not be provided at both plate members 16, 18 but the inductor core 10 may comprise only magnetic flux barrier 20.

With reference to FIG. 3*b*, the inner radial dimension of the external member 14 may be larger than the radial dimension of the plate members 16, 18. A radially outer magnetic flux barrier 24 may thus be arranged in the gap between the plate member 16 and the external member 14. Correspondingly, a radially outer magnetic flux barrier 26 may be arranged in the gap between the plate member 18 and the external member 14. The gap may be filled with air or some other material presenting a significantly reduced magnetic permeability.

With reference to FIG. 3*c*, the radial dimension of the through-hole 17 and 19 may be larger than the radial dimension of the portions of the core member 12 received by the through-holes 17, 19. Additionally, the inner radial dimension of the external member 14 may be larger than the radial dimension of the plate members 16, 18. A magnetic flux barrier 28*a* may thus be arranged in the gap between the plate member 16 and the external member 14 and a magnetic flux barrier 28*b* may be arranged in the gap between the core member 12 and the plate member 16. Correspondingly, a magnetic flux barrier 30*a* may be arranged in the gap between the plate member 18 and the external member 14 and a magnetic flux barrier 30*b* may be arranged in the gap between the core member 12 and the plate member 18.

According to one embodiment, the magnetic flux barrier may be integrated with the plate members 16, 18. For example a radially and circumferentially extending portion of each plate member 16, 18 may include a material of reduced magnetic permeability, thus forming ring-shaped magnetic flux barriers. The length of the radial portion may correspond to the full radial extension of the plate members 16, 18 or only a part thereof. As an example, a ring-shaped portion of each plate member 16, 18 may be provided with a plurality of bores or small volumes filled with air or other material presenting reduced magnetic permeability.

It should be noted that the inductor core 10 may be provided with a combination of the above-mentioned magnetic flux barriers. For example, the inductor core 10 may comprise a radially inner magnetic flux barrier 20 at one axial end and a radially outer magnetic flux barrier 26 at the opposite axial end. According to a further example, the inductor core 10 may comprise a radially inner magnetic flux barrier 20 at one axial end and a plate member 18 with an integrated magnetic flux barrier at the other end.

Figure 7A:
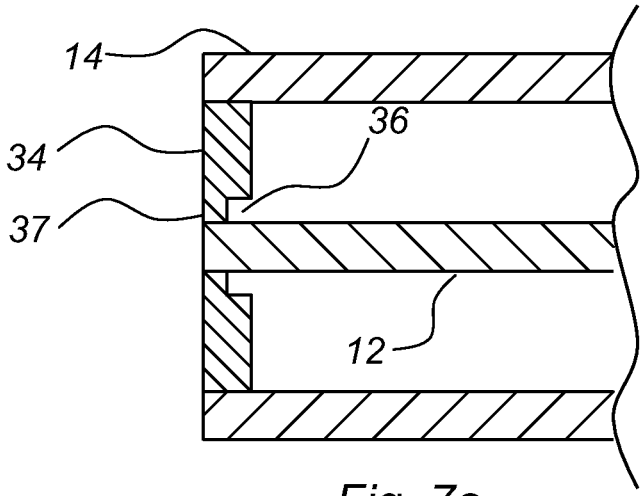
FIGS. 7*a* and 7*b* are sectional views taken along an axial direction illustrating a magnetic flux barrier in accordance with two further embodiments.
Figure 7B:
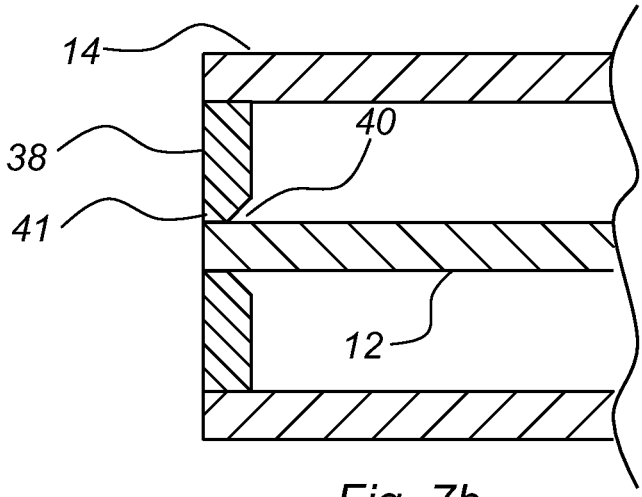
Figure 8:
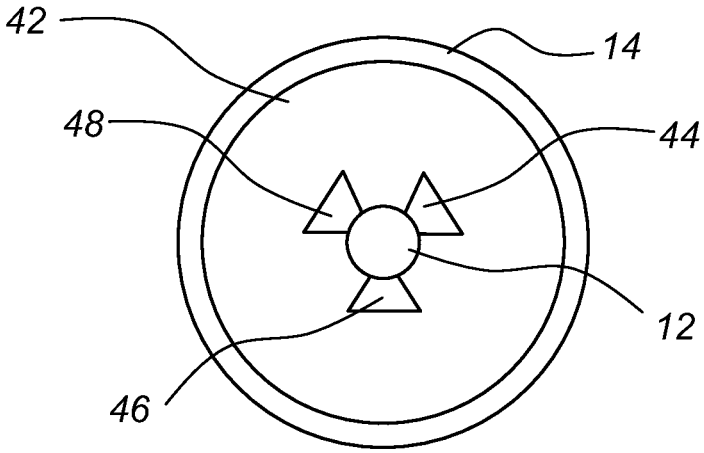
FIG. 8 illustrates a magnetic flux barrier in accordance with a further embodiment.

According to an alternative design, the core member and the plate member may be arranged in contact with each other. The plate member may be arranged such that the area of the contact surface with the core member is smaller than a cross sectional flux conducting area of the core member. Thereby an increased reluctance may be obtained at the transition between the core member and the plate member. Thereby a magnetic flux barrier may be formed at the transition between the core member and the plate member. FIGS. 7*a*, 7*b* and 8 illustrate various embodiments including such a magnetic flux barrier:

According to the embodiment illustrated in FIG. 7*a*, the plate member 34 and the core member 12 are arranged in contact with each other. The radial dimension of the through-hole matches the radial dimension of the portion of the core member 12 received by the through-hole. The plate member 34 includes a ring-shaped groove 36. A radial and circumferential section of the plate member 34 thus presents a reduced axial thickness compared to the other parts of the plate member 34.

The section of reduced axial thickness is arranged at the through-hole. The section of reduced axial thickness is arranged at the transition between the core member 12 and the plate member 34. The groove 36 reduces the area of the contact surface between the core member 12 and the plate member 34. Thereby the reluctance at the interface or transition between core member 12 and the plate member 34 may be increased such that a magnetic flux barrier is formed. The groove 36 may be arranged to make the area of the contact surface between the core member 12 and the plate member 34 smaller than the cross sectional flux conducting area of the core member 12. Thus a magnetic flux barrier may be formed at the transition between the core member 12 and the plate member 34. The groove 36 may present an axial depth and a radial length extension such that a magnetic flux barrier providing a desired contribution to the total reluctance of the magnetic flux path may be obtained. The axial depth of the groove 36 may be such that magnetic saturation occurs in the region of the core member 12 at the interface. The axial depth of the groove 36 may be such that magnetic saturation occurs in the region of the plate member 34 at the interface. The inductor core may thereby be used in a swinging choke core configuration.

According to the embodiment illustrated in FIG. 7*b* the plate member 38 may include a groove 40 presenting a gradually increasing axial depth along a direction towards the core member 12.

According to the embodiment illustrated in FIG. 8 the plate member 42 includes three recesses 44, 46, 48 arranged at the interface between the core member 12 and the plate member 42. It should be noted that the plate member may include any number of recesses, e.g. one, two, or more than three. The recesses are evenly distributed along the circumferential interface between the core member 12 and the plate member 42. Each recess reduces the circumferential extension of the contact surface between the core member 12 and the plate member 42. The plate member 42 engages the core member 12 along three arc-shaped segments. The recesses 44, 46, 48 may present a circumferential extension such that a magnetic flux barrier providing a desired contribution to the total reluctance of the magnetic flux path may be obtained. The circumferential extension of each recess 44, 46, 48 may be such that magnetic saturation occurs in the region of the core part 12 at the interface. The circumferential extension of each recess 44, 46, 48 may be such that magnetic saturation occurs in the region of the plate member 42 at the interface.

By providing through-holes (e.g. through-holes 17, 19) in the plate members (e.g. 16, 18) it becomes possible to have the core member 12 extending through and beyond the through-holes at one or both axial sides of the inductor core. The portions of the core member 12 protruding from the through-holes may be connected to cooling means wherein efficient cooling may be achieved.

Figure 4:
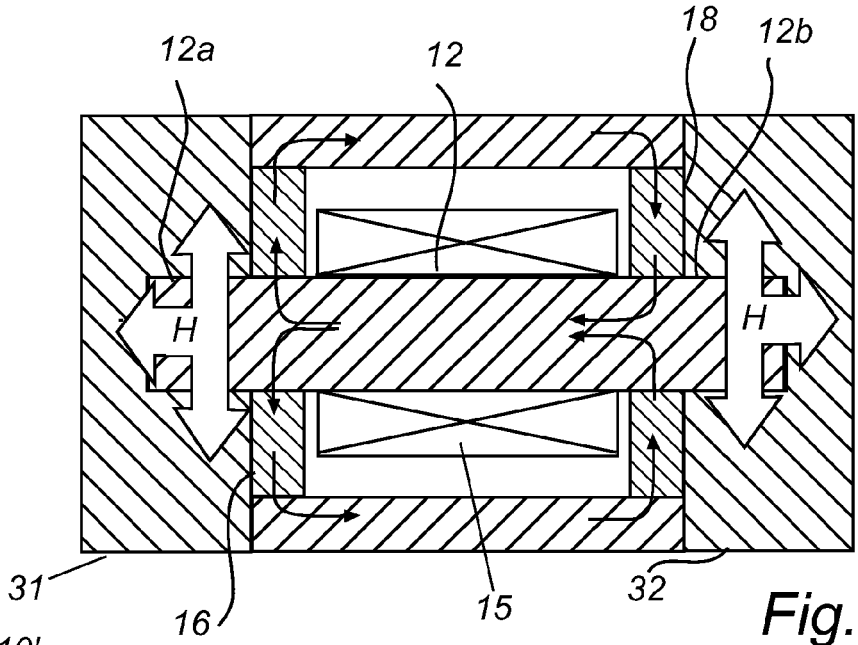
FIG. 4 is a sectional view taken along an axial direction illustrating an inductor core provided with cooling means.

FIG. 4 illustrates one such cooling arrangement wherein the protruding end portions 12*a* and 12*b* of the core member 12 engage with cooling means 31 and 32 respectively. The cooling means 31 and 32 may e.g. be a thermally conducting block wherein heat H may be dissipated by the core member 12. Advantageously, the cooling means 31, 32 are formed in a material having a lower magnetic permeability than the material forming the core member 12, the plate members 16, 18 and the external member 14, such that interference with the magnetic flux path P is minimized. By way of example, the cooling means 31, 32 may each be a block of aluminum.

Alternatively, a single-sided cooling configuration may be used, as opposed to the double-sided cooling configuration of above. In such a single-sided cooling configuration the core member 12 may extend through and beyond only one of plate members, e.g. plate member 16 wherein the protruding portion end portion 12*a* may engage with cooling means.

According to an optional design, only the first plate member 16 of the two plate members includes a through-hole 17 wherein the second plate member may be arranged as a lid to the inductor core 10, thus abutting with the axially facing end face of the core member 12.

Figure 6:
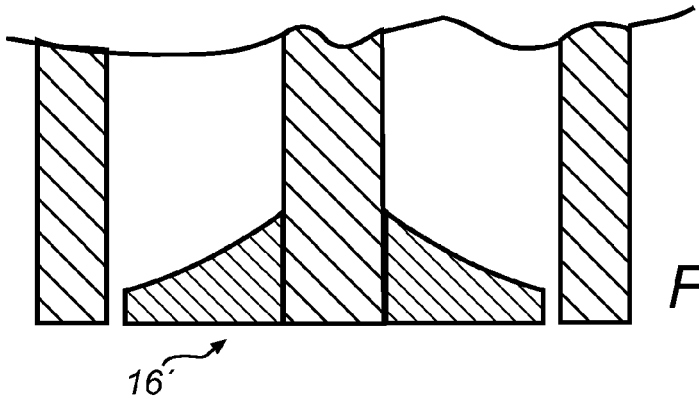
FIG. 6 is a sectional view taken along an axial direction illustrating a plate member according to an optional design.

FIG. 6 illustrates a plate member 16' of an alternative design. The plate member 16' presents an axial dimension which decreases along an outward radial direction. The flux conducting cross-sectional area of the plate member 16' is a function of the radial position along the radius of the plate member 16'. For the disc-shaped plate member 16' the area is:

$$A(r)=T(r)*2\pi r;$$

where T(r) is the axial dimension of the plate member 16' at the radial position r, for r larger than the radial dimension of the through-hole. The plate member 16' may thus present a decreasing axial dimension while keeping A(r) constant. The weight of the plate member 16' may thus be reduced without adversely affecting the flux conducting cross-sectional area. Advantageously, A(r) corresponds to the flux conducting cross-sectional area of the core member 12 and/or the external member 14.

Figure 5:
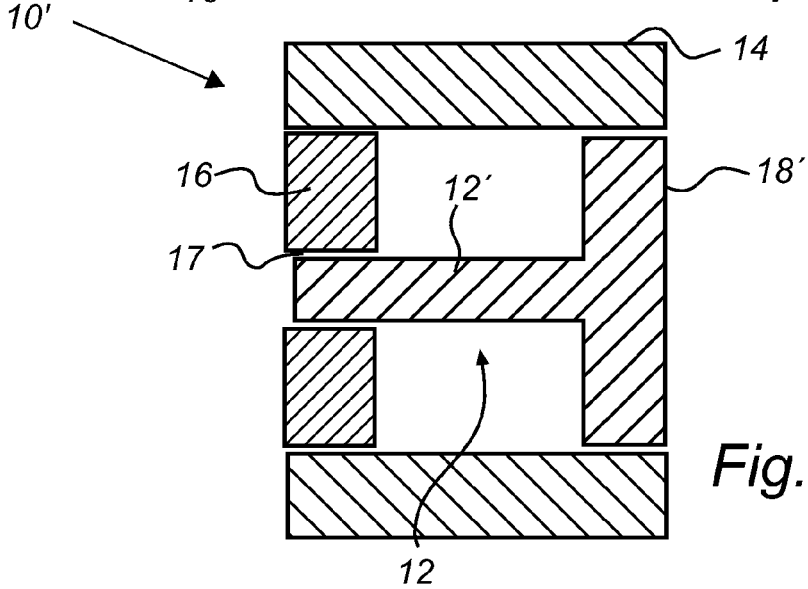
FIG. 5 is a sectional view taken along an axial direction illustrating an inductor according to an alternative embodiment.

FIG. 5 illustrates an inductor core 10' according to a further embodiment. The inductor core 10' is similar to the inductor core 10 described above however differs in that it comprises a disc-shaped second plate member 18' integrally formed with the core member 12. According to this alternative embodiment, the core member 12 thus comprises an axially extending core part 12' including, at one end, the second plate member 18' formed as a radially and circumferentially extending protrusion. The opposite end of the core part 12' extends into the through-hole 17 of the plate member 16. The external member 14 surrounds the plate member 16, the core part 12' and the plate member 18' in a circumferential direction. The interface between the plate member 18' and the external member 14 extends circumferentially and axially. This interface makes it possible to arrange a radially extending magnetic flux barrier between the external member 14 and the plate member 18' in a manner corresponding to that illustrated in FIG. 3*b*. Alternatively or additionally, the magnetic flux barrier may be integrated with the plate member 18' as discussed in relation to the inductor core 10.

Optionally, the core part 12' may extend through and beyond through-hole 17 of the plate member 16 wherein the portion of the core part 12' protruding from the through-hole 17' may engage with cooling means as discussed above in relation to FIG. 4. By providing the core member 12, the plate member 16 and the external member 14 as separate components a modular inductor core 10' is provided. The modular configuration makes it possible to form the inductor core 10' from a variety of different materials and material combinations, in analogy with the inductor core 10.

Similar to the inductor core 10, the axial separation between the plate member 16 and the plate member 18' of the inductor core 10' determines the axial length of the flux path P. Furthermore, the tolerance in the radial direction may be made relatively tight for the plate member 16 and 18' also when manufactured by compaction. Similar to the inductor core 10, the inductor core 10' hence also enables manufacturing of inductors presenting a precise inductance.

Although in the above, the inductor core 10' has been disclosed as an alternative embodiment to the inductor core 10, the inductor core 10' comprising the core member 12 including the core part 12' and the plate member 18' may be regarded as an independent inventive concept.

In the above, the inventive concept has mainly been described with reference to a few embodiments. However, as is readily appreciated by a person skilled in the art, other embodiments than the ones disclosed above are equally possible within the scope of the inventive concept, as defined by the appended claims.

For example, in the above inductor cores 10, 10' presenting a cylindrical geometry have been disclosed. However, the inventive concept is not limited to this geometry. For example, the core member 12, the external member 14 and the plate members 16, 18, 18' may present an oval, triangular, square or polygonal cross section.

In the above, inductor cores including members (e.g. members 12, 14, 16, 18) formed in a single piece have been described. According to an alternative embodiment, at least one of a core member, an external member, a first plate member and a second plate member may be formed from at least two parts which are adapted to be assembled and together form the member. This makes it possible to construct larger members and consequently also construct larger inductors. This may be particularly advantageous for an inductor including at least one member which is made of a soft magnetic powder material wherein otherwise, the dimensions of the member would be limited by the maximum pressing force the pressing tool is capable to apply.

For example, a member (e.g. the core member, the external member, the first plate member or the second plate member) may include a first and a second part. The first part may correspond to a first angular section of the member and the second part may correspond to a second angular section of the member. Alternatively, the first part may correspond to a first axial section of the member and the second part may correspond to a second axial section of the member. In any case, the first and the second part may be arranged to be assembled and together form the member. The first part may include a projecting portion and the second part may include a corresponding receiving portion wherein the parts are arranged to interlock. Alternatively, the parts may be assembled by gluing the parts together. It should be noted that a member may include more than two parts, e.g. three parts, four parts etc.

Figure 9:
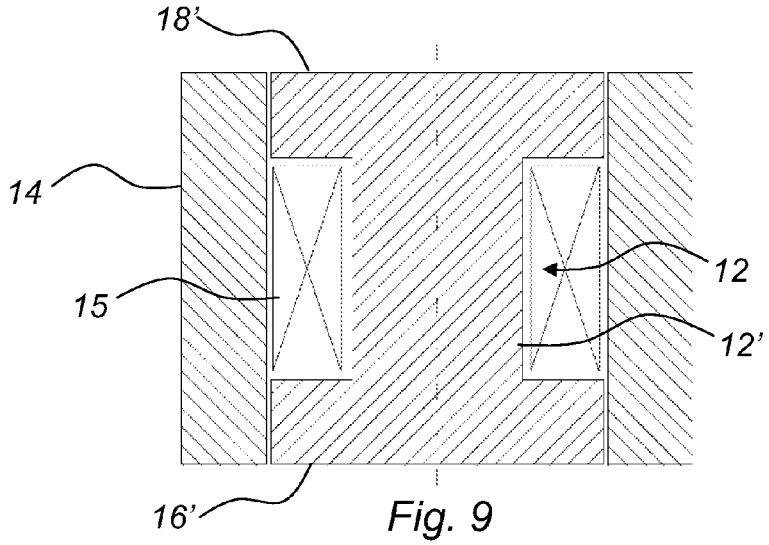
FIG. 9 is a sectional view taken along an axial direction illustrating an inductor core according to a further embodiment.

FIG. 9 illustrates an inductor core according to a further embodiment comprising a core member 12 including a core part 12', an external member 14, a first plate member 16' and a second plate member 18'. A winding 15 arranged around the core part 12' is schematically indicated. The first plate member 16' is formed in one piece with the core part 12'. The second plate member 18' is formed in one piece with the core part 12'. The first plate member 16' is arranged at one axial end of the core part 12'. The second plate member 18' is arranged at the opposite axial end of the core part 12'. The first plate member 16' and the second plate member 18' are thus formed as radially and circumferentially extending protrusions on the core part 12'. The external member 14 surrounds the core part 12', the first plate member 16' and the second plate member 18' in the circumferential direction. The interface between the plate member 16' and the external member 14 extends circumferentially and axially. The interface between the plate member 18' and the external member 14 extends circumferentially and axially. These interfaces makes it possible to arrange a magnetic flux barrier between the external member 14 and one or both of the plate members 16' and 18'.

Figure 10:
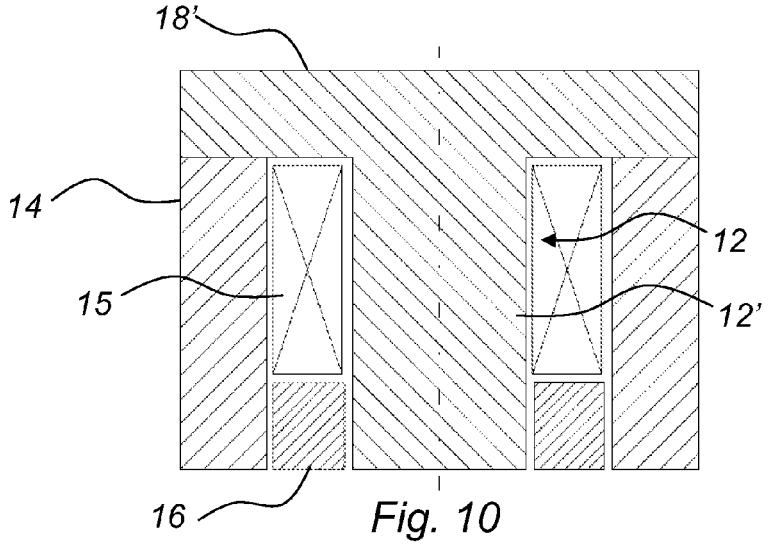
FIG. 10 is a sectional view taken along an axial direction illustrating an inductor core according to a further embodiment.

FIG. 10 illustrates an inductor core according to a further embodiment which is similar to the embodiment illustrated in FIG. 5 however differs in that the second plate member 18' presents a radial extension exceeding the inner radial dimension of the external member 14. The axial end surface of the external member 14 faces the second plate member 18'.

Figure 11:
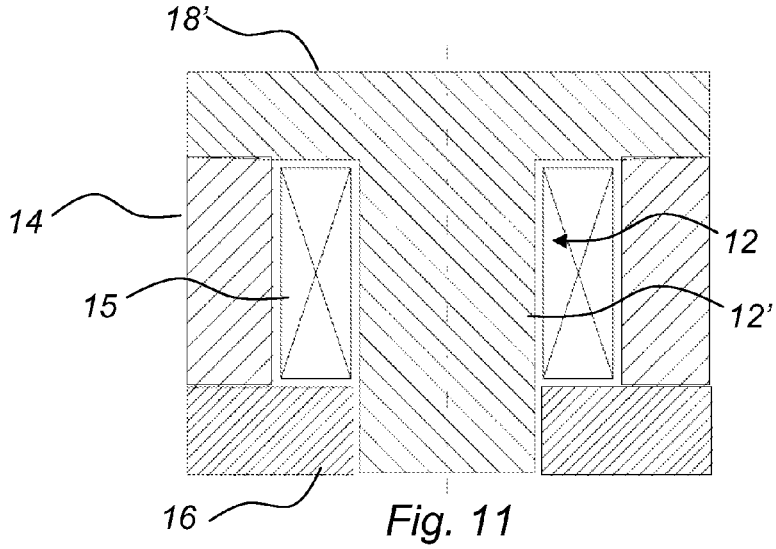
FIG. 11 is a sectional view taken along an axial direction illustrating an inductor core according to a further embodiment.

FIG. 11 illustrates an inductor core according to a further embodiment wherein also the plate member 16 presents a radial extension exceeding the inner radial dimension of the external member 14. One axial end surface of the external member 14 thus faces the first plate member 16 and the other axial end surface of the external member 14 faces the second plate member 18'.

Figure 12:
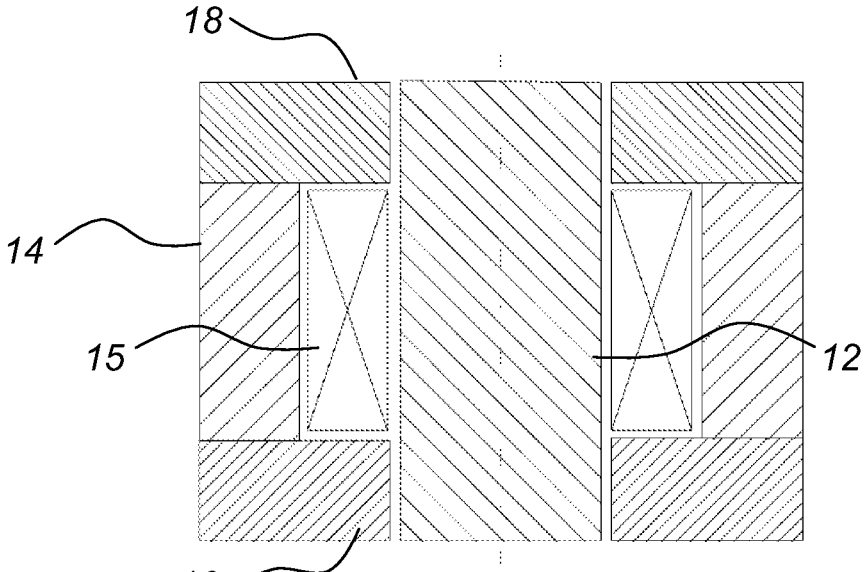
FIG. 12 is a sectional view taken along an axial direction illustrating an inductor core according to a further embodiment.

FIG. 12 illustrates an inductor core according to a further embodiment which is similar to the embodiment illustrated in FIG. 1 however differs in that the first plate member 16 presents a radial extension exceeding the inner radial dimension of the external member 14. The axial end surface of the external member 14 faces the first plate member 16. Also the second plate member 18 may present a radial extension exceeding the inner radial dimension of the external member 14. The other axial end surface of the external member 14 may then face the second plate member 18. In the embodiment shown in FIG. 12 a magnetic flux barrier may be arranged between the core member 12 and one or both of the plate members 16 and 18 as discussed above.

Figure 13:
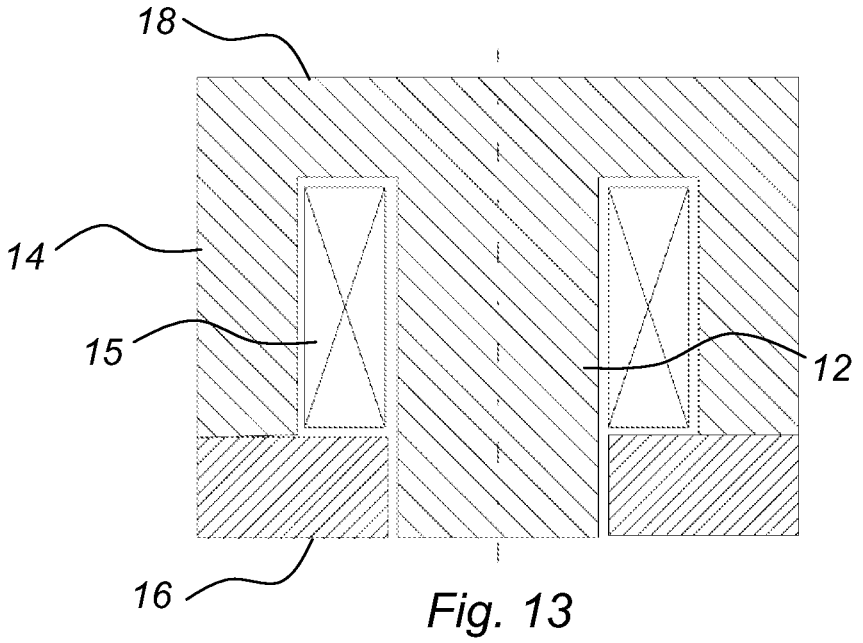
FIG. 13 is a sectional view taken along an axial direction illustrating an inductor core according to a further embodiment.

FIG. 13 illustrates an inductor core according to a further embodiment comprising a core member 12, an external member 14, a first plate member 16 and a second plate member 18. The second plate member 18 is formed in one piece with the core member 12 and the external member 14. The second plate member 18 extends in a radial direction between the core member 12 and the external member 14.

The invention claimed is:

1. Inductor core comprising:

an axially extending core member, an axially extending external member at least partly surrounding the core member, thereby forming a space around the core member for accommodating a winding between the core member and the external member, a first plate member presenting a radial extension and being provided with a through-hole, wherein the core member is arranged to extend into the through-hole of the first plate member, a second plate member presenting a radial extension and being provided with a through-hole, wherein the core member is arranged to receive an end portion of the core member, wherein the first plate member and the second plate member are provided at opposite ends of the external member, wherein the first plate member, the second plate member, the core member, and the external member are separate members which are adapted to be assembled and together form a magnetic flux path which extends through the core member, the first plate member, the second plate member, and the external member, and wherein at least one of the core member, the external member, the first plate member, and the second plate member is formed from a soft magnetic powder material and from at least two parts which are adapted to be assembled and together form said member.

2. Inductor core according to claim 1, further comprising a magnetic flux barrier arranged in a radially extending portion of said magnetic flux path, wherein the magnetic flux barrier is arranged between the core member and the first plate member, the magnetic flux barrier thereby separating the core member and the first plate member.

3. Inductor core according to claim 1, wherein the external member at least partly surrounds the first plate member.

4. Inductor core according to claim 1, wherein the external member at least partly surrounds the first plate member and the inductor core further comprises a magnetic flux barrier arranged between the first plate member and the external member, the magnetic flux barrier thereby separating the external member and the first plate member from each other.

5. Inductor core according to claim 4, further comprising a further magnetic flux barrier arranged between the core member and the first plate member, the magnetic flux barrier thereby separating the core member and the first plate member.

6. Inductor core according to claim 1, further comprising a magnetic flux barrier arranged in a radially extending portion of said magnetic flux path.

7. Inductor core according to claim 1, wherein the core member is made of a soft magnetic powder material.

8. Inductor core according to claim 7, wherein the first plate member is made of a plurality of laminated conducting sheets extending in a radial direction.

9. Inductor core according to claim 1, wherein the first plate member is made of a soft magnetic composite.

10. Inductor core according to claim 1, wherein the external member is made of a ferrite.

11. Inductor core according to claim 1, wherein a flux conducting cross-sectional area of the external member exceeds a flux conducting cross-sectional area of the core member.

12. Inductor core according to claim 1, wherein the core member and first plate member are arranged in contact with each other, the first plate member being arranged such that the area of the contact surface with the core member is smaller than a cross sectional flux conducting area of the core member.

13. Inductor core according to claim 12, wherein a radial and circumferential section of the first plate member presents a reduced axial thickness compared to other parts of the plate member, said section being arranged at through-hole of the first plate member.

14. Inductor core according to claim 1, further comprising cooling means wherein the core member is arranged to extend through and beyond the through-hole of the first plate member wherein a protruding end portion of the core member engages with said cooling means.

* * * * *